US007575016B2

(12) United States Patent
Hecking

(10) Patent No.: US 7,575,016 B2
(45) Date of Patent: Aug. 18, 2009

(54) PIPE DISCONNECTOR WITH INCREASED SEALING POWER

(75) Inventor: Willi Hecking, Niederkruechten-Elmpt (DE)

(73) Assignee: Hans Sasserath & Co. KG, Korschenbroich (DE)

( * ) Notice: Subject to any disclaimer, the term of this patent is extended or adjusted under 35 U.S.C. 154(b) by 486 days.

(21) Appl. No.: 11/546,466

(22) Filed: Oct. 10, 2006

(65) Prior Publication Data

US 2007/0079873 A1 Apr. 12, 2007

(30) Foreign Application Priority Data

Oct. 11, 2005 (DE) ..... 10 2005 049 110

(51) Int. Cl.
*E03C 1/10* (2006.01)

(52) U.S. Cl. ..... 137/218; 137/115.16; 137/512.2

(58) Field of Classification Search ..... 137/218, 137/454.2, 484.2, 512, 512.2, 542, 484.4, 137/484.6, 115.16, 115.2; 138/31
See application file for complete search history.

(56) References Cited

U.S. PATENT DOCUMENTS 4,013,088 A * 3/1977 Gocke et al. ..... 137/115.16
4,284,097 A * 8/1981 Becker et al. ..... 137/218
5,228,470 A * 7/1993 Lair et al. ..... 137/218
7,059,340 B2 * 6/2006 Hecking ..... 137/115.16

FOREIGN PATENT DOCUMENTS

DE 20 2005 008 021 U1 8/2005
EP 0 088 861 10/1986

* cited by examiner

*Primary Examiner*—John Rivell
*Assistant Examiner*—Craig M Schneider
(74) *Attorney, Agent, or Firm*—Thorpe North & Western LLP

(57) ABSTRACT

A system disconnector for disconnecting an upstream liquid system providing an inlet pressure from a downstream liquid system by a release valve (34) in response to a pressure drop between the systems, includes an upstream backflow preventer (40), a downstream backflow preventer (64) and a release valve body piston (18) arranged between the backflow preventers (40, 64). A pressure difference between the inlet pressure and a middle pressure between the backflow preventers (40,64) counteracts a spring (60) biasing the release valve body in the opening direction, the release valve body (18) having an effective pressurized surface (d) smaller than the surface effective for the inlet pressure. A hollow space (74) defined by the release valve body is connected to the middle pressure (66). A shiftable seat (76) provided in hollow space (74), is movable with respect to the release valve body to a fixed stop (84) upstream of the valve seat (32).

8 Claims, 4 Drawing Sheets

PIPE DISCONNECTOR WITH INCREASED SEALING POWER

TECHNICAL FIELD

The invention relates to a system disconnector for physically disconnecting an upstream liquid system from a downstream liquid system by means of a release valve in response to a pressure drop between the upstream and downstream liquid system, with an upstream backflow preventer, a downstream backflow preventer and a release valve body in the form of a piston which is, regarding the flow, arranged between the backflow preventers, an inlet pressure of the upstream liquid system upstream from the upstream backflow preventer, a middle pressure in a middle pressure space between the release valve body and the downstream backflow preventer and an outlet pressure of the downstream liquid system downstream of the downstream backflow preventer, wherein a pressure difference between the inlet pressure and the middle pressure counteracts a spring biasing the release valve body in the opening direction and wherein the release valve body has an effective pressurized surface which is smaller than the surface effective for the inlet pressure whereby a hollow space is defined by the release valve body and the hollow space is connected to the middle pressure space.

System disconnectors or pipe disconnectors serve to safely prevent a backflow of liquid from a downstream liquid system into an upstream liquid system. The upstream liquid system can be a drinking water system. The downstream liquid system can be, for example, a heating system. It must be prevented under all circumstances, that contaminated water from the heating system flows back into the drinking water system when the heating water system is filled or refilled, for example by a sudden drop of the pressure in the drinking water system for some reason. There are so called backflow preventers. They are spring-biased valves allowing a liquid flow only into one direction, i.e. from the upstream to the downstream system. However, such backflow preventers may leak. They are, therefore, not permitted if used alone for, for example, the disconnecting of the liquid systems of drinking water and heating water. A physical disconnection between the liquid systems must be effected in such way that in the case of a malfunctioning between the systems a connection to a release outlet and the atmosphere is established.

System—or pipe disconnectors comprise an upstream backflow preventer, which connects a backflow preventer to the upstream liquid system and a downstream backflow preventer which connects to the downstream system. A pressure controlled release valve is arranged between the backflow preventers which establishes a passage from the upstream liquid system and the downstream liquid system if there is a sufficient pressure drop between the two liquid systems in order to safely allow a liquid flow only form the upstream to the downstream liquid system. If there is not such a pressure drop, the release valve establishes a connection of the space between the backflow preventers with the atmosphere and an outlet.

In known backflow preventers the release valve is a piston moveably guided in a fitting casing. This piston is provided with a central passage and with an annular valve seat at its downstream end face which axially abuts an annular sealing fixed in the fitting. The passage provides a connection between the upstream and the downstream liquid system which is closed with respect to the atmosphere. The downstream backflow preventer is arranged in this passage. Thereby the pressure difference between the inlet pressure in the upstream liquid system and a middle pressure established in a middle pressure space between the piston and the downstream backflow preventer counteracts a spring biasing the piston against the opening direction. In order to allow a flow into the downstream system the pressure difference must exceed a given value determined by the spring power.

If—for example—a heating system having only a small water pressure has to be filled from a drinking water system through the system disconnector, the inlet pressure in the drinking water system will at first push the piston of the release valve against the effect of the spring acting thereon into an operational mode wherein it disconnects the connection to the atmosphere and to the outlet and connects the drinking water system and the heating system. Then the upstream and the downstream backflow preventer are pushed open. Drinking water flows to the heating system and fills or refills it. The heating system is then filled to an outlet pressure below the inlet pressure. During normal operation the difference between the inlet pressure and the outlet pressure is determined by the pressure difference between the backflow preventers, i.e. by the power of the springs of the backflow preventers. The middle pressure is therebetween corresponding to the pressure drop at the upstream backflow preventer and the pressure drop at the upstream backflow preventer. The pressure difference between the inlet pressure and the middle pressure must be greater than a threshold determined by the biasing spring of the valve body of the release valve.

A seat sealing is arranged in the valve seat of the release valve. It is, on one side, exposed to the middle pressure. On the other side the power of the release valve body acts on the sealing when the release valve is closed. If this power is not large enough, there is the danger of leaking.

The power of the release valve body acting on the sealing corresponds to the power by the upstream liquid system less the power on the release valve body by the middle pressure space and the constant spring power by the spring acting on the release valve.

If the effective surfaces of the release valve are changed while the pressure conditions in the inlet and in the middle pressure space remain unchanged, the respective forces change also. By reducing the seat diameter of the valve seat of the release valve a larger sealing power can be achieved. For a surface effective for the inlet pressure which is larger than for the middle pressure a further effect occurs: The power acting in the closing direction will become so large with high pressures, that the valve will not open anymore.

PRIOR ART

DE 20 2005 008 021 U1 describes a system disconnector where a stepped piston is guided as a release valve body in a two-part casing. The stepped piston forms a release valve with a seat edge and an annular valve seat. The valve seat has a smaller diameter than the inlet side outer diameter of the stepped piston. The hollow annular space defined between the outside of the piston and the casing is limited by an annular, casing fixed casing separation wall on the side of the middle pressure space clamped between the inlet side and the outlet side casing. The hollow annular space is hydraulically connected to the middle pressure space through a bore hole in the jacket of the stepped piston. The biasing spring acting on the release valve body is arranged outside around the stepped piston. The casing separation wall forms the spring abutment. This arrangement is complex and requires a lot of volume.

SUMMARY OF THE INVENTION

It is an object of the invention to provide a system disconnector of the above mentioned kind with an improved tightening power.

According to the invention this object is achieved in that a shiftable seat adapted to be moved in the moving direction of the release valve body is provided in the hollow space, movable with respect to the release valve body up to a casing fixed stop which is arranged in the flow direction upstream of the valve seat of the release valve.

In such a way a smaller valve seat can be realized for the release valve with a correspondingly higher tightening power without the release valve not functioning anymore at high inlet pressures. A valve seat with smaller seat diameter can be used which operates well at high and at low inlet pressures.

With increasing inlet pressure at first the release valve is closed. Afterwards the backflow preventer is opened. Then an increased pressure is present in the middle pressure space compared to the previously occurring atmospheric pressure. An increased pressure builds up in the hollow space, too, through the connection between the hollow space and the middle pressure space. This pressure is effective on the shiftable seat. The shiftable seat is moved in the direction of the valve seat up to the casing fixed stop. On the other side the pressure in the hollow space between the shiftable seat, the casing and the release valve body is also effective from the "back side" on the portion extending beyond the release valve body. The area effective for the middle pressure is, therefore, not reduced in such a way even if there is a smaller valve seat. Thereby the relation of the forces at the release valve body remains the same for the reduced valve seat diameter. However, the sealing power is larger, because the sealing has a smaller area. The effective pressurizing power and the quality of the sealing are increased accordingly.

Preferably the outlet side diameter of the release valve body is smaller than the inlet side diameter and the shiftable seat is formed by an annular jacket which is movably guided in the hollow space between the release valve body and the casing formed due to the diameter difference. The release valve body, therefore, forms a hollow space between the inlet side, thicker end and the outlet side end. The jacket can move in this hollow space. The casing fixed stop can be formed by an annular shoulder inside the casing. The jacket is pressed against the stop at middle pressure in the hollow space. Thereby the casing absorbs a portion of the pressure. In such a way a particularly compact arrangement is achieved.

In a further modification of the invention the annular jacket has an L-shaped cross-section, one of its legs abutting the inner side of the stop when it is exposed to middle pressure.

A passage for connecting the inside of the release valve body with the hollow space can be provided which is formed in the region between the casing, the release valve body and the shiftable seat. This passage can be, for example, established by a simple bore hole or an annular space with webs. The passage can run radially towards the inside from the hollow space and then in an axial direction downstream towards the middle pressure space.

In a preferred embodiment of the invention a first sealing is provided which is arranged in an annular groove in the outer surface of the release valve body in the region with a larger diameter and a second sealing which is arranged in the hollow space between the passage and the shiftable seat. In a particularly compact embodiment of the invention the backflow preventer, the release valve body, the biasing spring, the casing and the shiftable seat are coaxially arranged.

An embodiment is described below in greater detail with reference to the accompanying drawings. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

BRIEF DESCRIPTION OF THE DRAWINGS

In the accompanying drawings, which show the best modes presently contemplated for carrying out the invention.

DETAILED DESCRIPTION OF THE ILLUSTRATED EMBODIMENT

Figure 1:
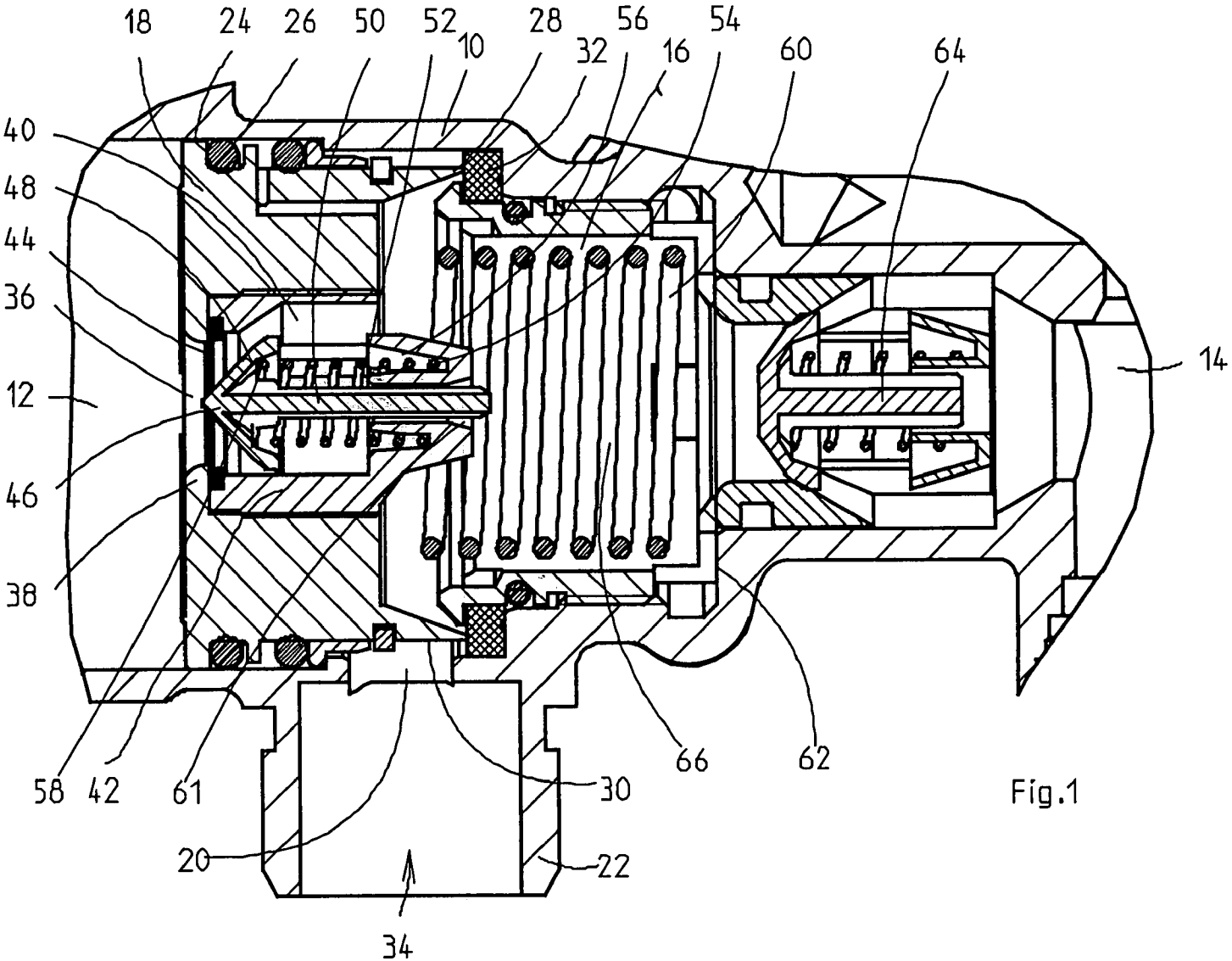
FIG. 1 is a cross section through a system disconnector with two backflow preventers and a release valve.

In FIG. 1 numeral 10 denotes a pipe-like fitting casing. The fitting casing 10 is provided with an inlet 12 and with an outlet 14 at its opposite end. A cylindrical chamber 16 is formed in the casing fitting 10. A piston-shaped valve body 18 is guided in the chamber 16. An outlet 20 branches off the chamber 16, which is provided with an outlet socket 22 connected to the atmosphere.

The valve body 18 is sealingly guided in the cylindrical chamber 16 with a sealing 26 on its outer surface 24. On its downstream end face 28 the valve body 18 defines an annular valve seat 30. The valve seat 30 abuts a seat sealing 32 in the downstream end position as shown in FIG. 1. The valve body 18 covers the outlet 20 with its outer surface 30. This is a release valve 34.

The valve body 18 is provided with a central passage 36. An annular flat rim 38 extending towards the inside is formed at the upstream end of the valve body 18. An upstream backflow preventer 40 is arranged in the passage 36. A valve seat 44 is arranged in the casing 42 of the backflow preventer. The valve seat 44 cooperates with a valve closing body 46. The valve closing body 46 is provided with a head 48 and a shaft 50. The shaft 50 is guided in a recess 61 in the casing 42. The shaft 50 is surrounded by a helical spring 52. The helical spring 52 is guided in an annular groove 56 in the casing 42 with one end 54 and abuts the head 48 with the other end 58.

A helical spring 60 abuts a shoulder 62 on the inside of the fitting casing 10 and abuts the downstream, backward side of the valve body 18 on its upstream side. Thereby the valve body 18 of the release valve is biased by the spring 60. The spring 60 ensures that the release valve is opened at all times in the absence of further forces.

Downstream of the described arrangement a downstream backflow preventer 64 is arranged in the fitting casing. Principally the backflow preventer 64 is designed in a similar way as the upstream backflow preventer 40 and is, therefore, not described in detail. Both backflow preventers 40 and 64 only open in the direction from the inlet pressure to the outlet pressure. A middle pressure space 66 is formed between the valve body 18 and the downstream backflow preventer 64.

Figure 2:
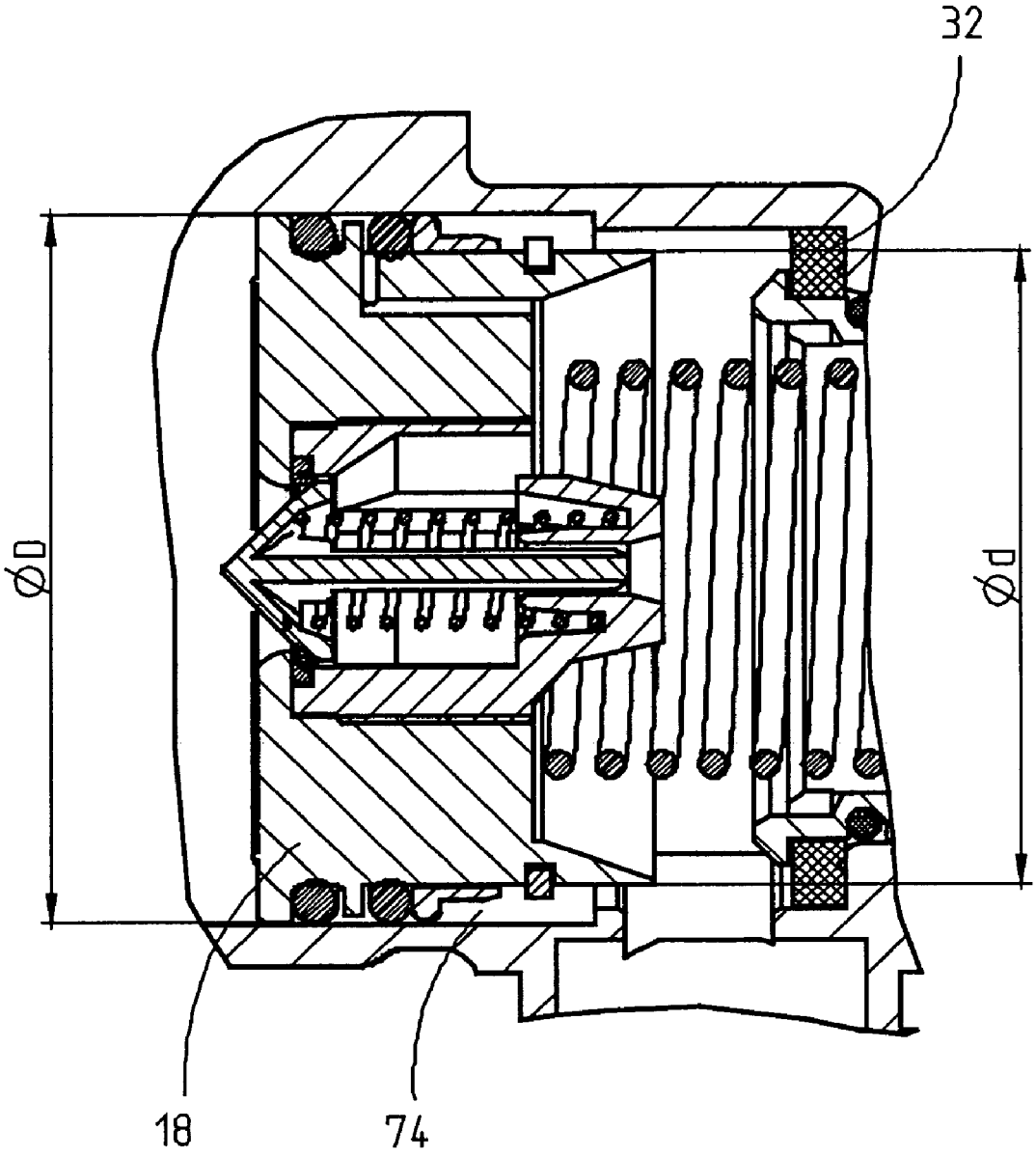
FIG. 2 shows a detail of the system disconnector of FIG. 1 with the inlet side backflow preventer and the open release valve.

The helical spring 52 of the backflow preventer 40 is stronger than the helical spring 60 acting on the valve body 18. Therefore, the backflow preventer 40 only opens if the valve body 18 has been moved by the pressure difference between the inlet pressure and the middle pressure present in the middle pressure space to its downstream end position. If in such way the passage to the outlet socket is closed with respect to the outlet 14 and the atmosphere the backflow preventers are opened by the water pressure. The heating system is filled to an outlet pressure which is slightly less than the inlet pressure. The release valve body 18 with the opened release valve is shown in FIG. 2 in greater detail. The upstream backflow preventer 40 is closed. There is no inlet pressure on the release valve body 18. The spring 60 is relaxed. In this state the release valve body is in a stop position where it is positioned in a distance from the seat sealing 32.

Figure 3:
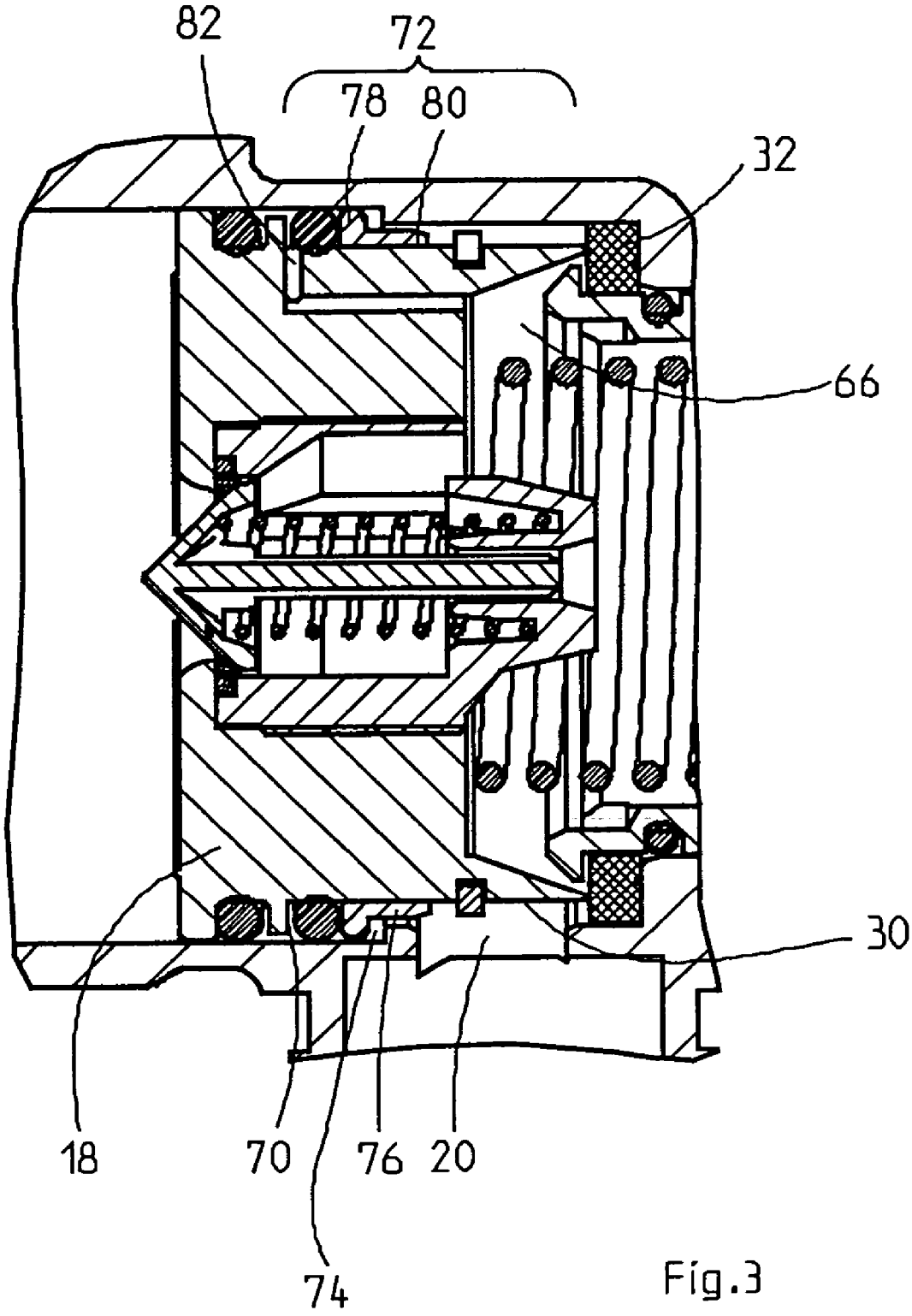
FIG. 3 shows the detail of FIG. 2 where the release valve is closed, but no pressure has built up in the middle pressure space when the backflow preventer is closed.

FIG. 3 shows a situation where the inlet pressure in the inlet of the fitting casing increases. Then the release valve body 18 moves towards the right in FIG. 3 against the spring power of the spring 60. The valve body 30 abuts the seat sealing 32 in its end position. The valve body 18 covers the outlet 20 with the jacket surface 30. Water cannot flow out. On the inlet side the release valve body 18 has a diameter designated with "D" in FIG. 2. The diameter corresponds to the inner diameter of the tube-shaped fitting casing 10. Furthermore, the release valve body 18 forms an annular shoulder 70 in such way that it has a smaller diameter on the downstream side. This smaller diameter is designated with "d" in FIG. 2.

The inlet pressure, therefore, acts on an area which is determined by the diameter D. The seat sealing 32 and the downstream side of the release valve body 18, however, have a smaller diameter.

In the region 72 of the smaller diameter of the release valve body an annular hollow space 74 is formed between the release valve body and the inside of the fitting casing 10. A shiftable seat 76 is guided in the hollow space 74. The shiftable seat 76 has a L-shaped cross section with legs 78 and 80. The shiftable seat 76 is movably guided in an axial direction. Furthermore a sealing ring 82 is provided in the hollow space 74. The hollow space 74 is hydraulically connected to the middle pressure chamber. In the region, where the outlet valve body 18 has a smaller diameter, a sealing 88 is provided between the step 70 and the shiftable seat 76.

The middle pressure in the middle pressure chamber 66 is also present in the hollow space 74. When the release valve 34 is opened, as it is shown in FIG. 2, the middle pressure is atmospheric pressure. If the release valve 34 is closed the middle pressure is increased with increasing inlet pressure. This situation is shown in FIG. 3. The shiftable seat 76 moves towards the right side in the drawing.

Figure 4:
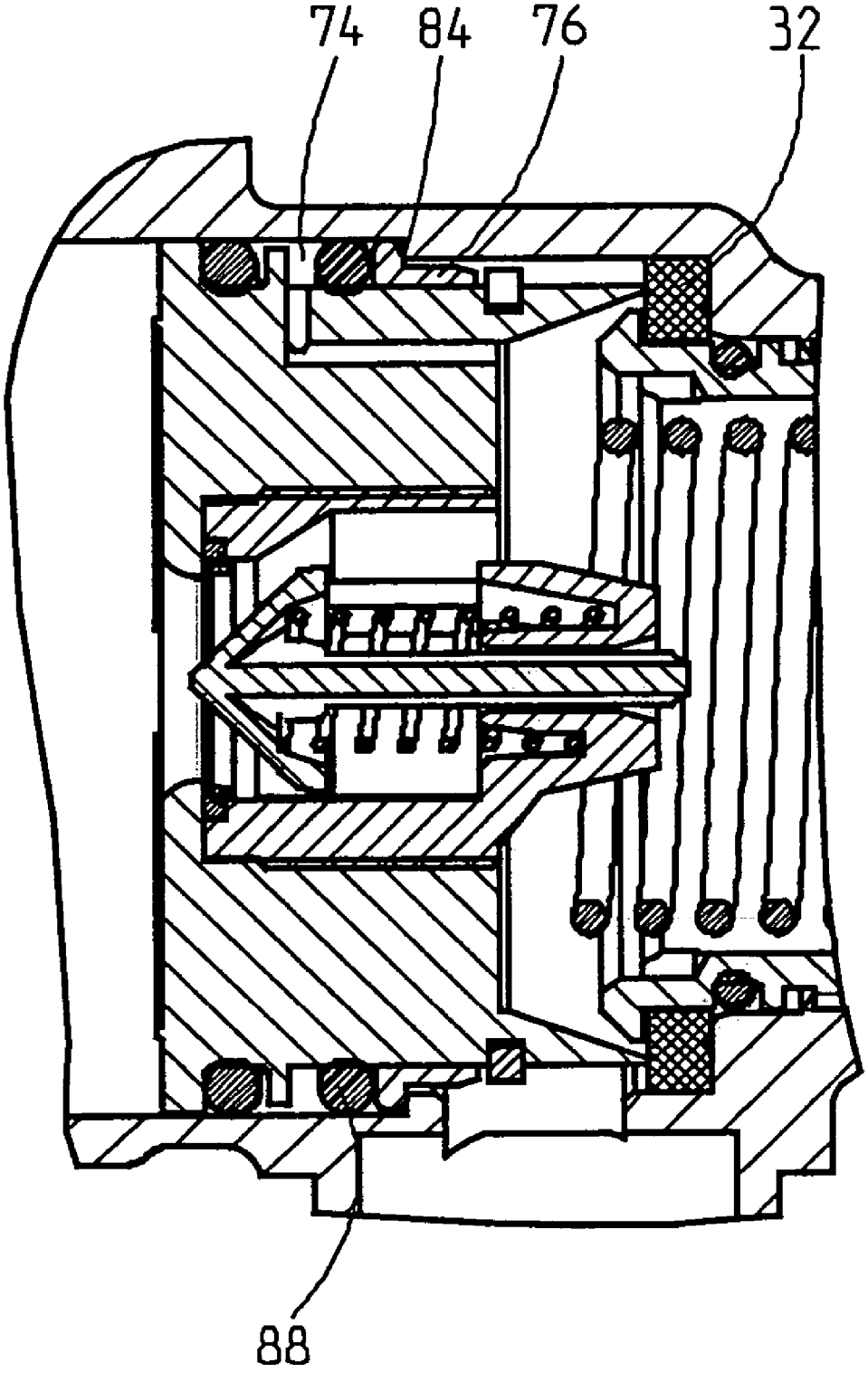
FIG. 4 shows the detail of FIGS. 2 and 3 when the release valve is closed and with an increased pressure in the middle pressure space when the backflow preventer is opened.

In FIG. 4 the situation is shown, where there is a high inlet pressure and the backflow preventer is opened. The release valve body 18 is in its right stop position against the spring power of the spring 60. The release valve is closed. The backflow preventer is opened. The middle pressure is also present in the hollow space 74. Due to this middle pressure the shiftable seat 76 is shifted into abutment of the leg 78 with the annular shoulder in the fitting casing. The pressure in the hollow space 74 is also effective on the backwards, projecting portion of the pressurized surface of the valve body 18. In such a way it is ensured that the effective area is the same for the middle pressure and for the inlet pressure. Thereby the forces on the valve body 18 are independent of the inlet pressure.

The valve seat sealing 32 has a reduced diameter in the described assembly. As the forces on the valve body remain the same also when the pressure conditions are not changed, the pressurizing force on the seat sealing 32, however, is larger. Thereby the sealing power is increased.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

What is claimed is:

1. A system disconnector for physically disconnecting an upstream liquid system having an inlet pressure from a downstream liquid system having an outlet pressure with a pressure drop between said upstream and said downstream system and thereby generating a flow from said upstream towards said downstream liquid system, said system disconnector comprising a casing, an upstream backflow preventer (40), said inlet pressure occurring upstream from said upstream backflow preventer (40), a downstream backflow preventer (64), said outlet pressure occurring downstream of said downstream backflow preventer (64), a release valve (34) with a valve seat (32) and an opening and a closing direction, said release valve (34) being adapted to disconnect in response to said pressure drop between said upstream and said downstream liquid system and comprising a release valve body (18) in the form of a piston which is, regarding said flow, arranged between said backflow preventers (40, 64), and has an effective pressurized surface (d), a middle pressure space (66) between said release valve body (18) and said downstream backflow preventer (64) with a middle pressure, a spring (60) biasing said release valve body in said opening direction and counteracting a pressure difference between said inlet pressure and said middle pressure, a hollow space (74) connected to the middle pressure space (66) and defined between said release valve body (18) and said casing, wherein said effective pressurised surface (d) of said release valve body (18) is smaller than said surface effective for said inlet pressure, and wherein a shiftable seat (76) is provided in said hollow space (74) which is adapted to be moved in said opening or closing direction of said release valve body, a casing fixed stop (84) is provided upstream of said valve seat (32) in said casing said shiftable seat movable with respect to said release valve body up to said casing fixed stop (84).

2. A system disconnector according to claim 1, wherein said release valve body has an inlet side diameter and an outlet side diameter which is smaller than said inlet side diameter and wherein said shiftable seat is formed by an annular jacket which is movably guided in said hollow space between said release valve body and said casing formed due to a diameter difference between said inlet side diameter and said outlet side diameter.

3. A system disconnector according to claim 2, wherein said casing fixed stop is formed by an annular shoulder inside said casing.

4. A system disconnector according to claim 3, wherein said annular jacket has an L-shaped cross-section with two legs, one of said legs abuting an inner side of said stop when it is exposed to said middle pressure.

5. A system disconnector according to claim 1, wherein said release valve body has a hollow inside, and further comprising a passage for connecting said inside of said release valve body with said hollow space limited in said region between said casing, said release valve body and said shiftable seat.

6. A system disconnector according to claim 5, wherein said passage runs radially towards said inside from said hollow space and then in an axial direction downstream towards said middle pressure space.

7. A system disconnector according to claim 5, comprising a first sealing (26) which is arranged in an annular groove in said outer surface of said release valve body in said region with a larger diameter and a second sealing (88) which is arranged in said hollow space between said passage and said shiftable seat.

8. A system disconnector according to claim 1, wherein said backflow preventer, said release valve body, said biasing spring, said casing and said shiftable seat are coaxially arranged.

* * * * *